US007871143B2

(12) United States Patent
Ahne et al.

(10) Patent No.: US 7,871,143 B2
(45) Date of Patent: Jan. 18, 2011

(54) GROUND STRUCTURE FOR TEMPERATURE-SENSING RESISTOR NOISE REDUCTION

(75) Inventors: Adam Jude Ahne, Lexington, KY (US); George K. Parish, Winchester, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 1689 days.

(21) Appl. No.: 10/883,426

(22) Filed: Jun. 30, 2004

(65) Prior Publication Data

US 2006/0001689 A1 Jan. 5, 2006

(51) Int. Cl.
*B41J 2/05* (2006.01)

(52) U.S. Cl. ..... 347/17; 347/5; 347/9

(58) Field of Classification Search ..... 347/14, 347/58, 67, 5, 9, 17, 19; 73/204.26; 29/612; 438/585

See application file for complete search history.

(56) References Cited

U.S. PATENT DOCUMENTS

| | | | | | |
|---|---|---|---|---|---|
| 4,910,528 | A * | 3/1990 | Firl et al. | ..... | 347/17 |
| 5,144,341 | A * | 9/1992 | El Haten et al. | ..... | 347/58 |
| 5,175,565 | A * | 12/1992 | Ishinaga et al. | ..... | 347/67 |
| 5,881,451 | A * | 3/1999 | Kneezel et al. | ..... | 29/612 |
| 5,943,069 | A * | 8/1999 | Kamiyama et al. | ..... | 347/14 |
| 5,944,970 | A | 8/1999 | Rosenblatt | | |
| 6,300,682 | B2 | 10/2001 | Chen | | |
| 6,391,752 | B1 * | 5/2002 | Colinge et al. | ..... | 438/585 |
| 6,399,991 | B1 | 6/2002 | Ando | | |
| 6,424,022 | B1 | 7/2002 | Wu et al. | | |
| 6,470,742 | B1 * | 10/2002 | Yamakawa et al. | ..... | 73/204.26 |
| 6,586,292 | B2 | 7/2003 | Kuramoto et al. | | |
| 2002/0164851 | A1 | 11/2002 | Wu et al. | | |
| 2003/0197242 | A1 | 10/2003 | Chen et al. | | |

* cited by examiner

*Primary Examiner*—Lam S Nguyen

(57) ABSTRACT

An inkjet printhead. The inkjet printhead includes a temperature-sensing resistor with a low voltage end which is connected to a ground structure that at least partially encloses the temperature sensing resistor.

18 Claims, 2 Drawing Sheets

GROUND STRUCTURE FOR TEMPERATURE-SENSING RESISTOR NOISE REDUCTION

BACKGROUND OF THE INVENTION

The present invention relates to inkjet printing apparatuses, and particularly to inkjet printheads.

An inkjet printhead generally has an ejector chip, such as a heater chip. The heater chip typically includes logic circuitry, a plurality of power transistors, and a set of heaters or resistors. A hardware or software printer driver will selectively address or energize the logic circuitry such that appropriate resistors are heated for printing. For example, when the resistors are heated, the temperature of the resistors is raised, and the ink is subsequently vaporized and ejected from the nozzles as ink droplets. To assure good print quality, it is important to accurately eject a precise amount of ink. In order to effect this goal, the temperature at the printhead has to be monitored and controlled.

Various techniques are used to measure the heat generated by or the temperature of the resistors during printing operation. For example, some printheads position a temperature sense resistor ("TSR") near the heaters on a substrate such that the TSR can sense or detect the temperature of the heaters. The TSR is typically grounded at the heater chip, which is connected to the substrate of the printhead. The heater chip ground potential may fluctuate with respect to the voltage of the TSR during printing, which results in a $\Delta V$ (i.e., a voltage shift between ground of the printer and the ground of the printhead). While the TSR can measure a heater temperature that ranges in a few mV per ° C., the $\Delta V$ caused by the ground fluctuation may create a noise as high as 200 mV per ° C. The amplitude of the noise is much greater than the signals to be measured, is difficult to filter, and may affect the overall accuracy of the temperature measurement. Any inaccuracy may lead to inadequate control of the heaters, which in turn may result in poor print quality.

SUMMARY OF THE INVENTION

Accordingly, there is a need for an improved method and apparatus for measuring temperature in an inkjet ejector chip. In one form, the invention provides an inkjet printhead that includes a temperature-sensing resistor. The temperature-sensing resistor has a low voltage end that is coupled to a ground structure (also referred to herein as a ground plane). In one form, the ground structure is a guard ring that at least partially encloses the temperature-sensing resistor. In other embodiments, the ground structure can assume any form or shape depending upon the components on the ejector chip.

In yet another form, the invention provides a method of reducing noise in a temperature-sensing resistor implanted on an ejector chip having an ejector chip ground. The method includes the act of determining a lower voltage end of the temperature-sensing resistor that is electrically spaced apart from the ejector chip ground. Thereafter, the method comprises the acts of at least partially enclosing the temperature-sensing resistor with a ground structure, and connecting the ground structure to the lower voltage end of the temperature-sensing resistor.

In yet another form, the invention provides an inkjet printing apparatus. The inkjet printing apparatus comprises a printing apparatus ground, and a printhead. The printhead has a printhead chip ground and a ground structure that at least partially encloses a temperature-sensing resistor. The temperature sensing resistor has a low voltage end that is coupled to the ground structure and the printing apparatus ground thereby bypasses the printhead chip ground.

In yet another form, the invention provides an ejector chip. The ejector chip comprises an ejector chip ground that has a first ground potential of the ejector chip. The ejector chip also comprises a bond pad that is electrically spaced apart from the ejector chip ground and is coupled to a second ground that has a second ground potential. The ejector chip also comprises a ground structure that is coupled to the bond pad and thus has the second ground potential, and a temperature sensing resistor that is coupled to the bond pad and thus also has the second ground potential.

Other features and advantages of the invention will become apparent to those skilled in the art upon review of the following detailed description, claims, and drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. In addition, the terms "connected" and "coupled" and variations thereof are not restricted to physical or mechanical connections or couplings.

The invention generally relates to a printhead having a nozzle portion used to produce multiple print drop-volumes for printing in a variety of modes, including without limitation, draft mode, high-quality mode and a combination thereof. As used herein and in the appended claims, the term "ink" can refer to at least one of inks, dyes, stains, pigments, colorants, tints, a combination thereof, and any other material commonly used for inkjet printers. As used herein and in the appended claims, the term "printing medium" can refer to at least one of paper (including without limitation stock paper, stationary, tissue paper, homemade paper, and the like), film, tape, photo paper, a combination thereof, and any other medium commonly used in inkjet printers.

Figure 1:
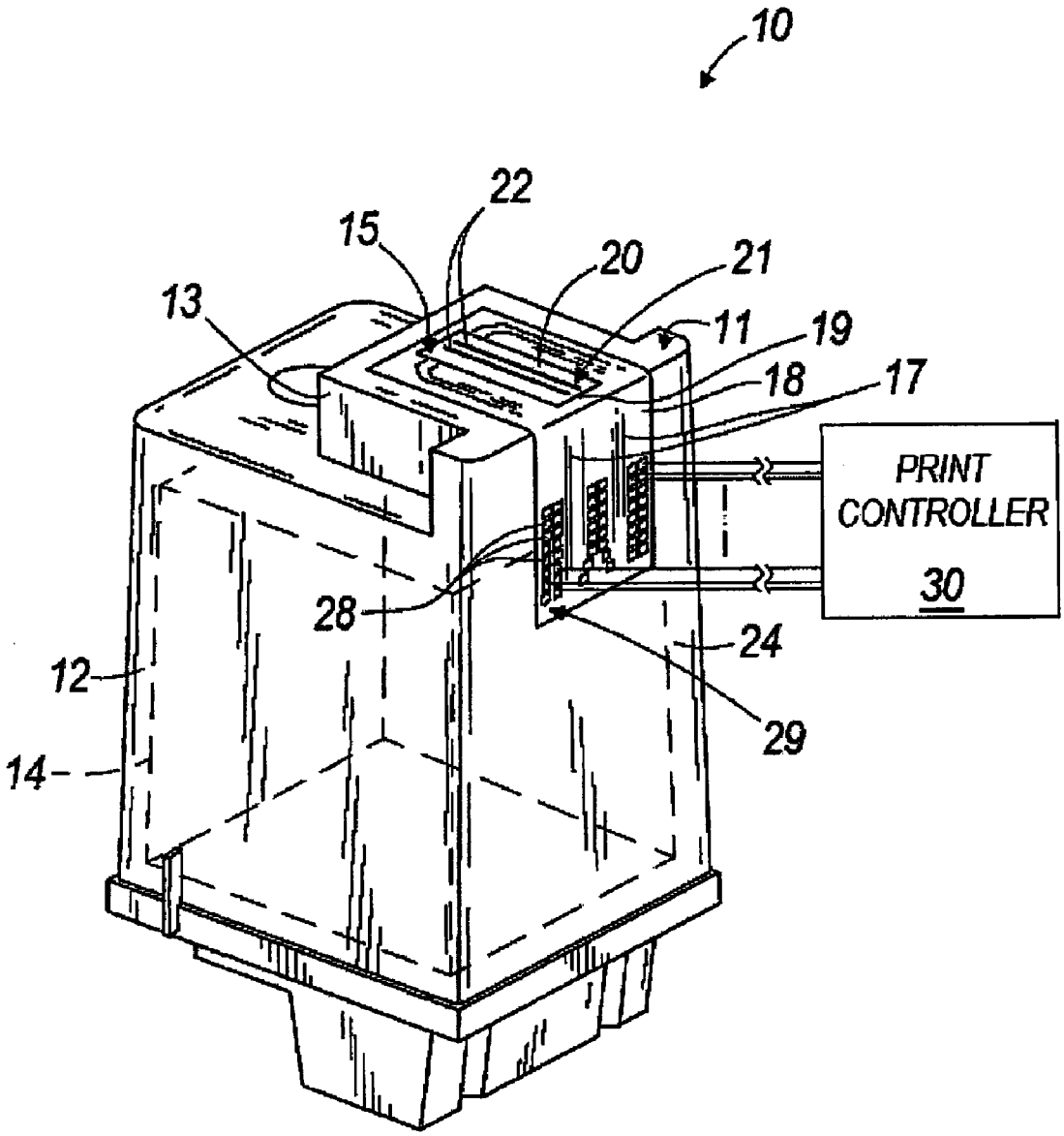
FIG. 1 illustrates an inkjet printhead according to one embodiment of the invention.

FIG. 1 illustrates an inkjet printhead 10 according to one embodiment of the invention. The printhead 10 includes a housing 12 that defines a nosepiece 13 and an ink reservoir 14 containing ink or a foam insert saturated with ink. The housing 12 can be constructed of a variety of materials including, without limitation, one or a combination of polymers, metals, ceramics, composites, and the like. The inkjet printhead 10 illustrated in FIG. 1 has been inverted to illustrate a nozzle portion 15 of the printhead 10. The nozzle portion 15 is located at least partially on a bottom surface 11 of the nosepiece 13 for transferring ink from the ink reservoir 14 onto a print medium (not shown). The nozzle portion 15 can include an ejector chip, such as heater chip 16 (detailed in FIG. 2) and a nozzle plate 20 having a plurality of nozzles 22 that define a nozzle arrangement and from which ink droplets are ejected onto the print medium that is advanced through a printer (not shown). The nozzles 22 can have any cross-sectional shape desired including, without limitation, circular, elliptical, square, rectangular, and any other polygonal shape that allows ink to be transferred from the printhead 10 to the print medium.

Figure 2:
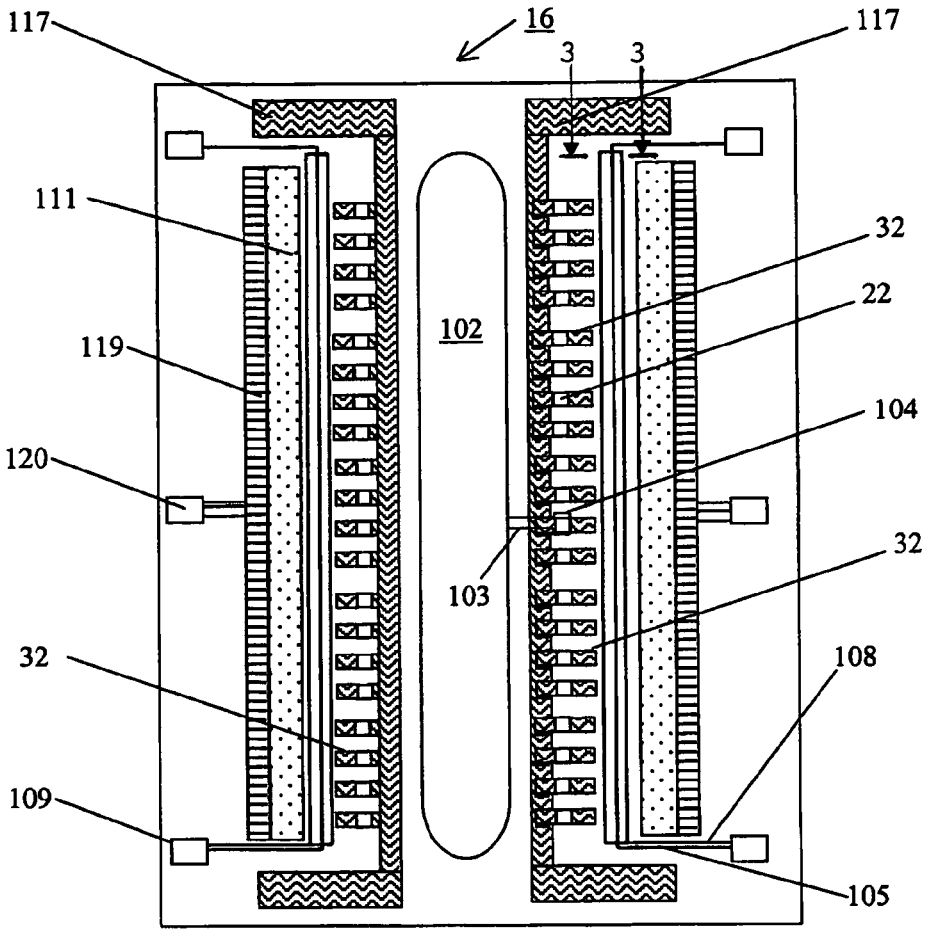
FIG. 2 shows an embodiment of a heater chip according to the invention.

The heater chip 16, hidden from view in the assembled printhead 10 illustrated in FIG. 1, is detailed in FIG. 2. The heater chip 16 is also attached to the nozzle plate 20 in a removed area or cutout portion 19 of the tape member 18. The heater chip 16 is attached such that an outwardly facing surface 21 of the nozzle plate 20 is generally flush with and parallel to an outer surface 29 of the tape member 18 for directing ink onto the print medium via the plurality of nozzles 22 in fluid communication with the ink reservoir 14. Although a thermal inkjet printing apparatus is used in the example, other types of inkjet technology such as piezoelectric technology can also be used with the invention.

The conductive traces 17 can be provided on the tape member 18 by a variety of methods, including without limitation, plating processes, photolithographic etching, and any other method known to those of ordinary skill in the art. Each conductive trace 17 connects, directly or indirectly, at one end to the heater chip 16 at some bond pads. Similarly, each conductive trace 17 also connects, directly or indirectly, at the other end to a contact pad 28. Each contact pad 28 also extends through to the outer surface 29 of the tape member 18. The contact pads 28 are positioned to mate with corresponding contacts on a carriage (not shown) to communicate between a microprocessor-based printer controller 30 and components of the printhead 10 such as the heat transducers or heaters 32, as will be described in greater detail below. The tape member 18 can be formed of a variety of other polymers or materials capable of providing conductive traces 17 to electrically connect the nozzle portion 15 of the printhead 10 to the contact pads 28, the bond pads, and the printer controller 30.

FIG. 2 shows a portion of the heater chip 16 according to one embodiment of the invention. Like parts are referenced with like numerals. The heater chip 16 can be formed of a variety of materials including, without limitation, various forms of doped or non-doped silicon, doped or non-doped germanium, or any other semiconductor material. The heater chip 16 is positioned to be in electrical communication with conductive traces 17 provided on an underside of the tape member 18. The heater chip 16 includes a plurality of heaters 32 linked by a second set of conductive traces 117 on the heater chip 16. The heaters 32 can include any transducer capable of converting electrical energy into heat, such as a resistor, and particularly, a thin-film resistor. Electrical signals are sent from the printer controller 30 to the heaters 32 via the conductive traces 117 to heat or energize the heaters 32 thereby vaporizes the ink in a chamber 102 depending on the mode of printing that has been selected. Specifically, when the electrical signals such as current or voltage reach some pre-determined level, the heat dissipated by the heaters 32 nucleates the ink contacting the heaters 32. In this way, an ink bubble can be formed, and an ink droplet is expelled from the nozzle 22 onto the print medium.

The nozzles 22, the chamber 102, a channel 103, and ink recesses (not shown), can be collectively referred to as flow features 104. In some embodiments, the nozzle plate 20 can include more than one layer or substrate, and the flow features can be defined in any of the layers or substrates by methods known to those skilled in the art. For example, defining the flow features 104 can include, without limitation, at least one of laser ablation, vapor deposition, lithography, plasma etching, metal electrode position, and a combination thereof. In other embodiments, the flow features 104 can be defined in one layer. In addition, the flow features 104 do not need to be defined in the same layer(s), but rather, some of the flow features can be defined in one or more first layers, and other flow features (e.g., the nozzles 22) can be defined in a second layer. Furthermore, in embodiments employing more than one nozzle plate layer, the layers do not need to be made of the same materials, and the method(s) used to define flow features in one layer do not need to be same method(s) used to define flow features in the other layers(s). For example, the nozzle plate 20 can include one or more thin or thick film layers that have flow features defined by methods including at least one of lithography, vapor deposition and plasma etching, and the nozzle plate 20 can include one or more layers of polyimide having flow features defined by laser ablation.

Referring back to FIG. 2, the amount of ink ejected from each of the chambers 102 can be affected by factors such as the size of the heaters 32, and the size and shape of the corresponding nozzle 22. For example, the size of the heaters 32 can control the heat generated, and therefore the temperature of the ink. Also other factors such as surface tension and viscosity of the ink, along with the relatively small size of the nozzles 22 and the pressure established by the ink reservoir 14 inhibit the ink from spilling out of the nozzles 22 until the corresponding heaters 32 are actuated. In particular, when the resistive elements or the heaters 32 of the heater chip 16 are energized, the heat generated changes the surface tension and viscosity of the ink stored in the chambers 102, and furthermore, the ink droplet sizes.

Furthermore, a temperature sensing resistor ("TSR") 105 is positioned adjacent the heaters 32 to measure or sense the amount of heat generated by the heaters 32 to effectuate ink droplet control. Typically, implanting an N-type material or negatively charged material into the P-type substrate or positively charged material such as silicon forms $N^+$ source drain ("NSD") TSR resistors. A ground structure 108 of P-type material generally encloses, at least partially, the TSR 105 to provide an electrical shield at least partially surrounding the TSR 105. The ground structure 108 is also connected to the TSR 105 at a bond pad 109 that shunts the current flowing between the P-type material substrate and the TSR ground structure 108 to a printer or printing apparatus ground (not shown) through a low voltage side of the TSR 105, and the bond pad 109. Specifically, the TSR 105 is typically forced, but not limited to being forced, to have a low voltage end. In particular, the low voltage end can be driven (and a high voltage end detected, measured, sensed or determined), and is thereafter coupled to the bond pad 109 that is electrically spaced apart or has a different voltage potential. Coupling the ground structure 108 to the low voltage end, the bond pad 109 and the printing apparatus ground thus avoids a $\Delta V$ shift.

The heater chip 16 also includes a plurality of field effect transistors ("FET") collectively referred to as a FET area 111 to address or energize the resistive elements or the heaters 32 in a manner known in the art. The FET area 111 is electrically connected to a chip ground 114. The FET area 111 is sandwiched between the ground structure 108 and a chip ground bus 119 which is connected to a chip ground 120 having a chip ground potential. More specifically, the NSD TSR 105 is partially or fully enclosed by the ground structure 108, i.e. the substrate contacts to a metal conductor. In this way, since the chip ground 120 is electrically spaced apart from the bond pad 109, the ground structure 108 around the TSR 105 provides a lower impedance path for noise generated during printing. That is, ground structure 108 eliminates the ΔV shift, and thereby minimizes the noise measured during temperature determinations while printing.

Figure 3:
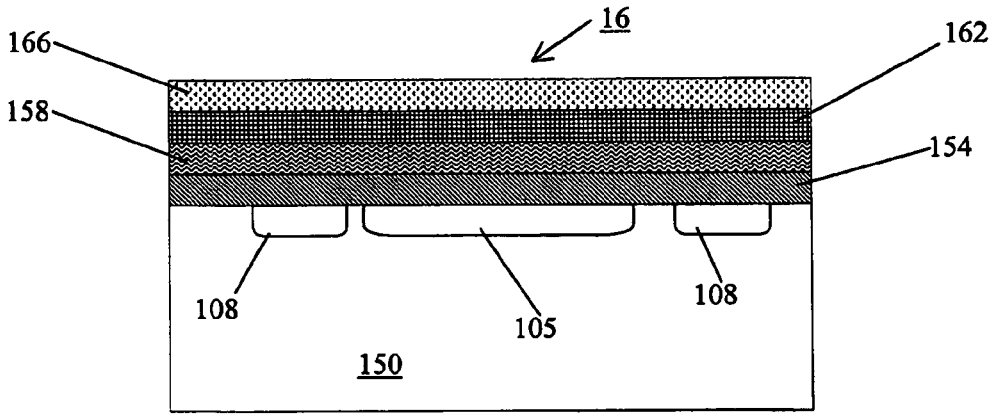
FIG. 3 shows a partial cross section of a temperature sensing resistor and a ground structure taken along line 3-3 in FIG. 2.

FIG. 3 shows a cross section view of the heater chip 16 near the TSR 105. The NSD TSR 105 is at least partially enclosed by the P-type ground structure 108 where one end of the ground structure 108 is connected to the printer ground via the bond pad 109. Both the NSD TSR 105 and the P-type ground structures 108 are implanted in a substrate 150. The substrate 150 can be a silicon chip with various thicknesses depending on application. A dielectric layer 154 also having various thicknesses is deposited on top of the substrate 150 to thermally insulate the substrate 150 from heat. The dielectric layer 154 can consist of different materials such as Silicon Dioxide ("$SiO_2$"), Boron Phosphorus doped glass ("BPSG"), Phosphorus-doped glass ("PSG"), or Spun-on glass ("SOG"). In this way, the energy generated in a resistive layer 158 or the heaters 32 can be insulated from the substrate 150 when current flows through the resistive layer 158. The resistive layer 158 can include materials such as Tantalum Aluminum ("TaAl"), Tantalum Nitride ("TaN"), Hafnium Diboride ("$HfB_2$"), materials having both high tolerance for high temperatures and high resistivity, and the like. To protect the resistive layer 158 from ink corrosion effect during the vapor bubble bursts, a second layer of dielectrics 162 can be deposited over resistive layer 158. The dielectric 162 can include materials such as including Silicon Nitride ("SiN"), Silicon Carbide ("SiC"), and Tantalum ("Ta") films. The second layer of dielectrics 162 is further sandwiched between the metal layer 158 and a second metal layer 166. The second metal layer 166 can be connected to the FET area 111, and have materials such as Aluminum ("Al"), Aluminum Copper ("AlCu"), Aluminum Silicon ("AlSi"), or some other aluminum alloy with low resistivity. Of course other layers of materials can also be deposited onto the heater chip 16 as needed by different applications.

Various features and advantages of the invention are set forth in the following claims.

The invention claimed is:

1. An inkjet printhead comprising:

an array of printing elements;

an array of driving elements for driving the array of printing elements;

a temperature sensing resistor adjacently extending along the arrays and positioned between the arrays for sensing heat generated from the printing elements, and configured to have a low voltage end; and a ground structure coupled to the temperature sensing resistor at the low voltage end and at least partially enclosing the temperature sensing resistor to electrically shield the temperature sensing resistor from an electrical ground potential of an ejector chip of the printhead, the array of driving elements spacing the temperature sensing resistor from the electrical ground potential.

2. The inkjet printhead of claim 1, further comprising a heater positioned adjacent the ground structure, and configured to generate heat.

3. The inkjet printhead of claim 1, further comprising a transducer configured to be energized and to eject ink.

4. The inkjet printhead of claim 1, further comprising a field effect transistor ("FET") positioned adjacent the ground structure.

5. The inkjet printhead of claim 1, and wherein the temperature sensing resistor comprises N-type material implanted in a P-type substrate.

6. The inkjet printhead of claim 1, and wherein the ground structure comprises a P-type material.

7. An inkjet printing apparatus comprising:

a printing apparatus ground; and a printhead having:

an array of printing elements;

an array of driving elements for driving the array of printing elements;

a printhead chip ground; and a ground structure at least partially enclosing a temperature sensing resistor adjacently extending along the arrays and positioned between the arrays for sensing heat generated from the printing elements, to electrically shield the temperature sensing resistor from the printhead chip ground, the array of driving elements spacing the temperature sensing resistor from an electrical ground potential of the printhead chip ground, wherein the temperature sensing resistor having a low voltage end being coupled to the ground structure and the printing apparatus ground thereby bypassing the printhead chip ground.

8. The inkjet printing apparatus of claim 7, further comprising a heater positioned adjacent the ground structure, and configured to generate heat.

9. The inkjet printing apparatus of claim 7, further comprising a transducer configured to be energized and to eject ink.

10. The inkjet printing apparatus of claim 7, further comprising a field effect transistor ("FET") positioned adjacent the ground structure.

11. The inkjet printing apparatus of claim 7, and wherein the temperature sensing resistor comprises N-type material implanted in a P-type substrate.

12. The inkjet printing apparatus of claim 7, and wherein the ground structure comprises a P-type material.

13. A method of reducing noise in a temperature sensing resistor for sensing heat generated from an array of printing elements in a printhead, the temperature sensing resistor is implanted adjacently extending along and between the array of printing elements and an array of driving elements spacing the temperature sensing resistor from an electrical ground potential of a printhead chip ground of the printhead, the method comprising the acts of:

determining a lower voltage end electrically spaced apart from the printhead chip ground at the temperature sensing resistor;

at least partially enclosing the temperature sensing resistor with a ground structure to electrically shield the temperature sensing resistor from the electrical ground potential of the printhead chip ground; and connecting the ground structure to the lower voltage end of the temperature sensing resistor.

14. The method of claim 13, further comprising the act of coupling the lower voltage end of the temperature sensing resistor to a printer ground different from the ejector chip ground.

15. The method of claim 13, and wherein at least partially enclosing the temperature sensing resistor further comprises the act of implanting a P-type material in the temperature sensing resistor.

16. The method of claim 13, further comprising the act of positioning a transducer adjacent the ground structure.

17. The method of claim 13, further comprising the act of positioning a field effect transistor ("FET") adjacent the ground structure.

18. The method of claim 13, and wherein the temperature sensing resistor further comprises an N-type material implanted in a P-type substrate.

* * * * *